US006212728B1

(12) United States Patent
Facca et al.

(10) Patent No.: US 6,212,728 B1
(45) Date of Patent: Apr. 10, 2001

(54) SELF-WRINGING RATCHET MOP

(75) Inventors: Andrew G. Facca, Windsor (CA); Joseph M. Wilen, Atlanta, GA (US); James LaBelle, San Marcos, CA (US)

(73) Assignee: Multi-Reach, Inc., London (CA)

( * ) Notice: Subject to any disclaimer, the term of this patent is extended or adjusted under 35 U.S.C. 154(b) by 0 days.

(21) Appl. No.: 09/203,723

(22) Filed: Dec. 2, 1998

Related U.S. Application Data

(60) Provisional application No. 60/067,121, filed on Dec. 2, 1997.

(51) Int. Cl.[7] ..... A47L 13/142

(52) U.S. Cl. ..... 15/120.2; 15/120.1

(58) Field of Search ..... 15/120.1, 120.2, 15/119.1, 119.2, 116.1, 116.2, 229.1, 229.2

(56) References Cited

U.S. PATENT DOCUMENTS

| | | |
|---|---|---|
| Re. 15,274 | 1/1922 | Kenner . |
| 462,100 | 10/1891 | Mullen . |
| 695,043 | 3/1902 | Gee . |
| 728,332 | 5/1903 | Thomas . |
| 973,491 | 10/1910 | Fischer, Jr. . |
| 1,224,524 | 5/1917 | Courtney . |
| 1,426,440 | 8/1922 | Zieschang . |
| 1,466,169 | 8/1923 | Hultqvist . |
| 1,514,051 | 11/1924 | Jumonville . |
| 1,520,500 | 12/1924 | Jumonville . |
| 1,527,234 | 2/1925 | Swasey . |
| 1,529,143 | 3/1925 | Pollard . |
| 1,585,306 | 5/1926 | MacPherson . |
| 1,700,136 | 1/1929 | Leidgen . |
| 1,709,622 | 4/1929 | Justis . |
| 1,710,190 | 4/1929 | Regan . |
| 1,760,695 | 5/1930 | Hertzberg . |
| 1,814,527 | 7/1931 | Potter, Jr. . |
| 1,848,481 | 3/1932 | Hertzberg . |
| 1,861,795 | 6/1932 | Hertzberg . |
| 2,230,101 | 1/1941 | Bakemeier . |
| 2,286,944 | 6/1942 | Altland . |
| 2,365,437 | 12/1944 | Schaefer . |
| 2,495,846 | 1/1950 | Johnson . |
| 2,677,838 | 5/1954 | Jouban . |
| 3,072,943 | 1/1963 | Cone . |
| 3,278,977 | 10/1966 | Makar . |
| 3,334,369 | 8/1967 | Makar . |
| 3,462,788 | 8/1969 | Abbott . |
| 3,699,603 | 10/1972 | Popell . |
| 3,946,457 | 3/1976 | Robinson . |
| 4,130,910 | 12/1978 | Raven . |

(List continued on next page.)

FOREIGN PATENT DOCUMENTS

| | | |
|---|---|---|
| 27 40 417 | 3/1978 | (DE) . |
| 1459284 | 11/1966 | (FR) . |
| 2622785 | 5/1989 | (FR) . |

* cited by examiner

*Primary Examiner*—Robert J. Warden, Sr.
*Assistant Examiner*—Kaj K. Olsen
(74) *Attorney, Agent, or Firm*—Young & Basile, P.C.

(57) ABSTRACT

A self-wringing ratchet mop is disclosed to comprise an elongate handle including at least one channel provided along a discrete length thereof, a tubular member slidably and rotatably disposed on the handle, and a mop swab connected to the handle and the tubular member. The tubular member has a wall including at least one pawl formed therein. The at least one pawl is engageable with the at least one channel to resist rotation of the tubular member in a first direction about the handle, and the at least one pawl is further flexibly moveable out of engagement with the at least one channel when the tubular member is rotated in a second direction about the handle. And when the at least one pawl is positioned along a length of the mop handle other than the discrete length, the tubular member is freely rotatable in both the first and second directions about the mop handle.

19 Claims, 4 Drawing Sheets

U.S. PATENT DOCUMENTS

| | | | | |
|---|---|---|---|---|
| 4,178,650 | | 12/1979 | Aasland . | |
| 4,464,807 | | 8/1984 | Weiss . | |
| 4,479,278 | | 10/1984 | Heinonen . | |
| 4,809,387 | | 3/1989 | Nakamura et al. . | |
| 4,903,366 | | 2/1990 | Traglia . | |
| 5,060,338 | | 10/1991 | Yates et al. . | |
| 5,509,163 | | 4/1996 | Morad . | |
| 5,566,417 | | 10/1996 | Hsieh . | |
| 5,577,290 | | 11/1996 | Monahan . | |
| 5,642,551 | | 7/1997 | Cann et al. . | |
| 5,850,658 | * | 12/1998 | Specht | 15/120.1 |
| 5,875,509 | * | 12/1998 | Facca | 15/120.1 |
| 6,115,869 | * | 9/2000 | Libman | 15/120.1 |

* cited by examiner

FIG-6
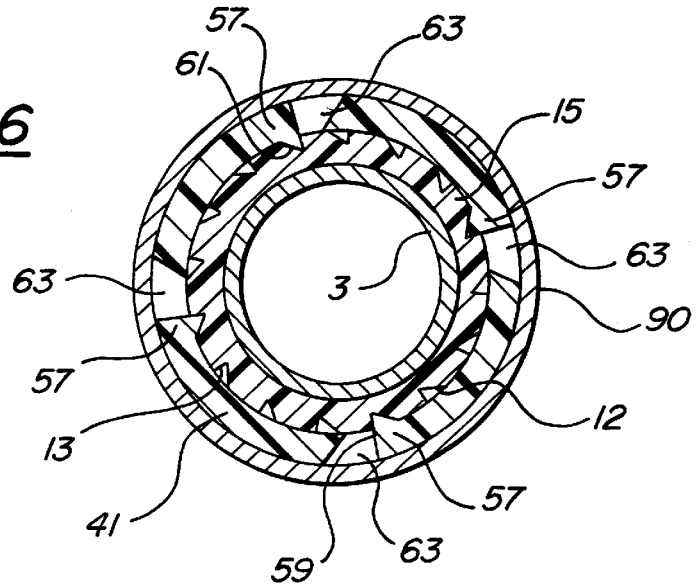
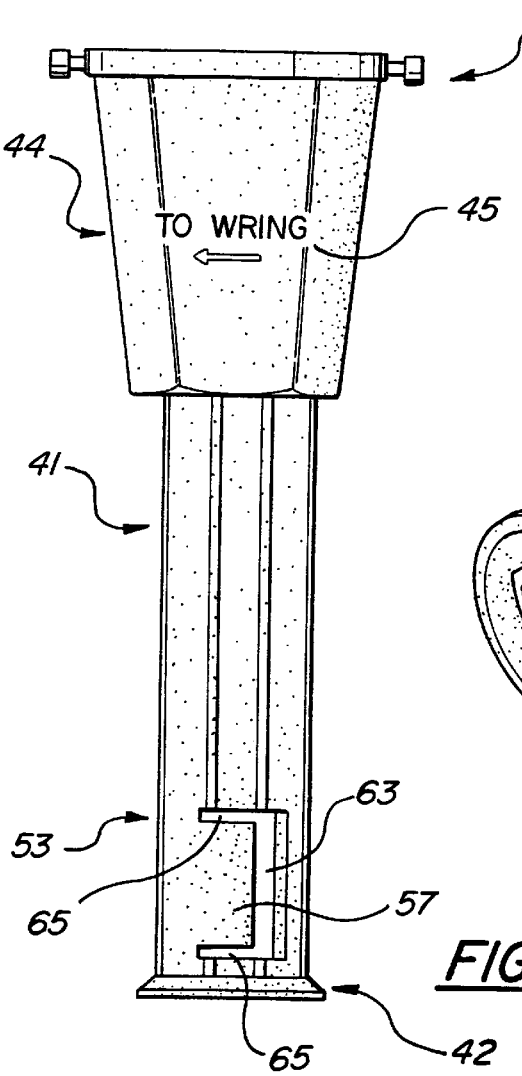
FIG-4
FIG-5
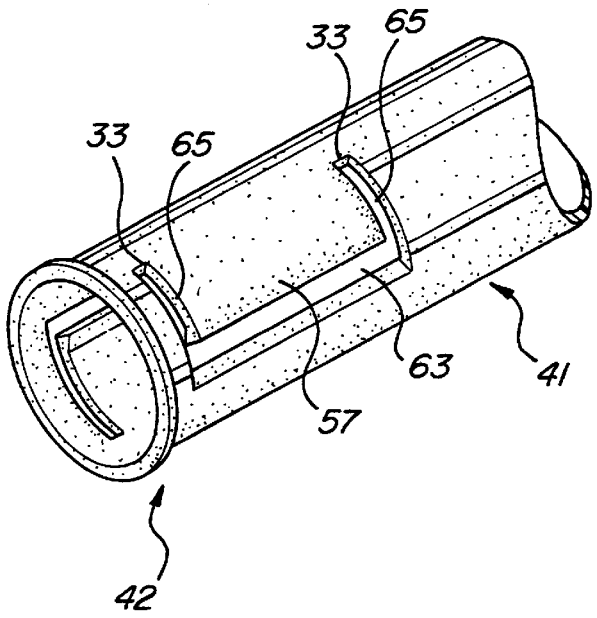

SELF-WRINGING RATCHET MOP

CROSS-REFERENCE TO RELATED APPLICATION

This application claims the benefit of U.S. Provisional Application Serial No. 60/067,121, filed Dec. 2, 1997.

FIELD OF INVENTION

The present invention relates to wringable mops, and more particularly to self-wringing ratchet mops.

DESCRIPTION OF THE PRIOR ART

Self-wringing mops are well known and have been the subject of numerous improvements over the years. A typical self-wringing mop generally comprises an elongate handle having upper and lower ends, a sleeve coaxially disposed on the handle and both slidable and rotatable with respect thereto, and a mop swab attached to both the lower end of the handle and the lower end of the sleeve such that, by sliding the sleeve relative to the handle, the mop swab may be selectively placed in a generally flattened condition for mopping, or extended for drying. In its extended condition, the sleeve is rotated about the handle to twist and therefore wring the mop swab. The mop of Heinonen, U.S. Pat. No. 4,479,278 is exemplary.

One known disadvantage of early self-wringing mops was the lack of a mechanism to prevent the mop swab from unwinding under the increasing tension of the mop swab during the wringing operation. If the mop handle or sleeve either accidentally slipped or was released from the user's hands before the mop swab was wrung sufficiently dry, tension on the swab tended to cause movement of the sleeve or mop handle relative to each other, thereby returning the swab to its unwound condition.

A number of issued patents have attempted to overcome this disadvantage, and the solutions are varied. U.S. Pat. No. 2,495,846, issued to Johnson, discloses a combined mop and wringer head having, according to one embodiment, a pawl and ratchet-wheel mechanism provided in a box-like head at the lower end of the mop handle. The ratchet wheel is slidably associated with a plunger rod provided internal of the handle; movement of the plunger rod relative to the handle resulting in wringing of the mop swab. The ratchet wheel is shown revolving in a clockwise direction with the handle during the wringing operation, the pawl engaging the ratchet wheel to prevent counter-rotation, and thereby maintaining the mop in a twisted condition. Johnson discloses that the pawl is provided on a plate pivotally attached to the box-like head, which plate must be swung out of contact with the ratchet wheel at the conclusion of the wringing operation in order to allow turning of the handle in a counter-clockwise direction so as to return the mop swab to its unwrung, useable condition. As is apparent from the foregoing description, the mechanism of the Johnson patent is unfortunately complex, requiring numerous parts.

U.S. Pat. No. 2,677,838, issued to Jouban, discloses a wringer mop comprising a tubular body slidingly disposed on the mop handle and an externally screw-threaded nut fixed in place along the length of the mop handle. To wring the mop swab, the tubular body is pulled along the mop handle towards the nut, thereby stretching the mop swab lengthwise. As the tubular body and nut are brought into threading engagement, the mop swab is twisted about the mop handle and wrung dry. To return the mop swab to its unwound, useable condition, the tubular body and nut must be threadingly disengaged.

U.S. Pat. No. 5,509,163, issued to Morad, discloses a self-wringing mop comprising an outer tubular sleeve which is movable longitudinally and rotatably over an inner shaft, a mop head, a locking body, a handle, and a one-way spring-and-ratchet mechanism. The spring and ratchet mechanism comprises a spring-biased pawl located on the outer tubular sleeve, the pawl being engageable with longitudinal ribs provided on the inner shaft to permit rotation of the outer sleeve in only one direction in order to wring the mop head. To allow counter-rotation of the outer sleeve, the pawl is urged radially outward against the spring until it is disengaged from the longitudinal ribs, permitting the outer sleeve to rotate freely about the inner shaft so that the mop head can be returned to its initial position. Like Johnson, the mop of the Morad patent also requires the use of additional parts, such as a separate spring and pawl. This adds to the complexity of the Morad mop. Moreover, the spring-biased pawl of the Morad mop is prone to breaking, particularly when the pawl is urged against the longitudinal ribs against the intended direction of rotation of the outer sleeve.

Additionally, Jumonville, U.S. Pat. No. 1,514,051, teaches a mop of the self-wringing variety having a handle, a slidable and rotatable sleeve, and a plurality of mop strands associated with both the sleeve and the handle. A metallic sleeve is provided over a portion of the handle and includes a plurality of ratchets cooperating with a radially movable ratchet button provided on the slidable and rotatable sleeve. To wring the Jumonville mop, it is taught that the sleeve is pulled upwardly along the handle so that the ratchets are engaged by the ratchet button as the mop strands are extended. The sleeve is then turned about the handle and inward pressure is applied to the ratchet button, thus twisting the mop strands. When, by means of such twisting, the mop strands are brought under sufficient wringing tension, Jumonville teaches that cooperation between the ratchet button and ratchets serves to hold the sleeve against rotation about the handle. As with other prior art devices, however, the Jumonville device is complex in construction.

SUMMARY OF THE INVENTION

Accordingly, it is an object of the present invention to provide an improved self-wringing ratchet mop with a pawl designed as an integral component of a movable tubular grip sleeve in order to minimize the number of component parts of the mop.

It is a further object of the present invention to provide a self-wringing ratchet mop which is simple in construction, inexpensive, and durable.

These and other objects and advantages of the present invention are accomplished through the provision of a self-wringing ratchet mop comprising an elongate handle having at least one channel provided along a discrete length thereof, a tubular member slidably and rotatably disposed on the handle, the tubular member having a wall formed to include at least one pawl, and a mop swab connected to the handle and the tubular member. The wall of the tubular member is cut to define a living hinge on which the at least one pawl is flexibly radially moveable.

The at least one pawl is positionable over the discrete length of the handle so as to be engageable with the at least one channel to resist rotation of the tubular member in a first direction about the handle. The at least one pawl is further radially moveable out of engagement with the at least one channel when the tubular member is rotated in a second direction about the handle.

In operation, the mop swab is wrung by sliding the tubular member along the handle to engage the at least one pawl with the at least one longitudinal channel. With the pawl thus engaged, the tubular member is rotatable in only one direction, so that if the user releases his hold on the tubular member, the mop swab does not completely unwind. To unwind the mop swab, the tubular member is slid along the handle until the at least one pawl is disengaged from the at least one longitudinal channel, the tubular member subsequently being freely rotatable about the mop handle so that the mop swab may be brought back to its original, unwound condition.

According to one feature of this invention, a ratchet sleeve is provided defining an opening therethrough for receiving the handle. The sleeve includes radially opposed interior and exterior surfaces, the exterior surface including the at least one longitudinal channel thereon. The sleeve is dimensioned to be receivable within the tubular member.

According to a further feature of this invention, the at least one pawl may comprise a plurality of pawls, while the at least one channel may comprise a plurality of channels.

These and other objects and advantages of the present invention will become apparent upon reference to both the specification and the drawings.

BRIEF DESCRIPTION OF THE DRAWINGS

FIG. 4 is an elevational view of the grip sleeve of the present invention;

FIG. 5 is a detailed perspective view of the pawl of the present invention;

FIG. 6 is a cross section of the pawl and ratchet sleeve of the present invention;

DETAILED DESCRIPTION OF THE ILLUSTRATED EMBODIMENT

Figure 1:
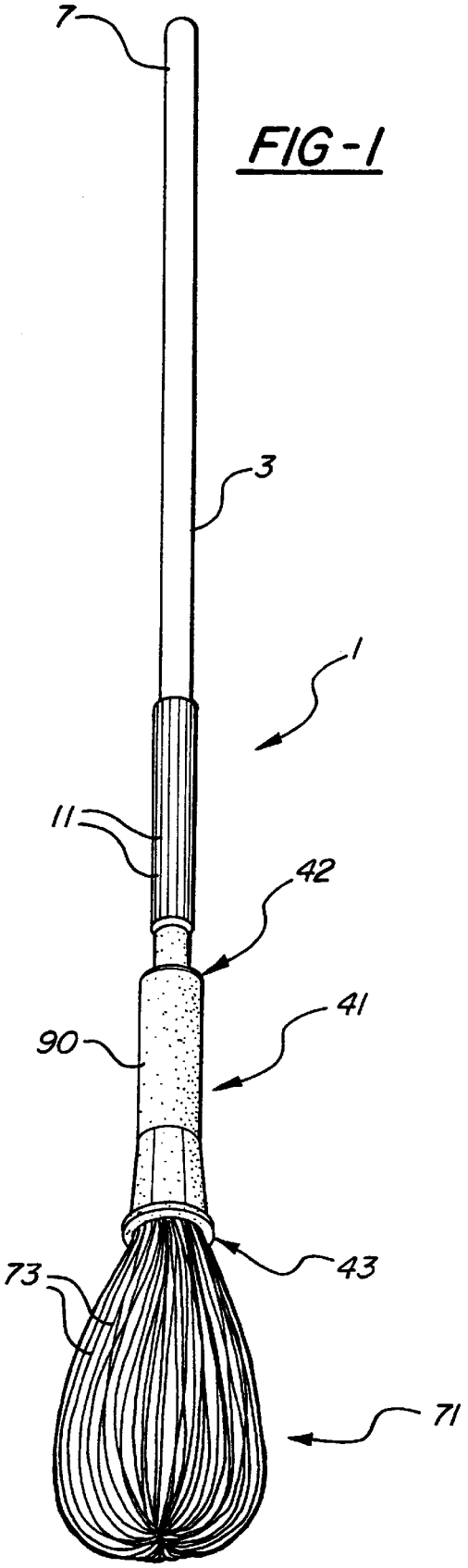
FIG. 1 is an elevational view of the improved self-wringing ratchet mop of the present invention showing the mop swab in its initial, unwound condition.
Figure 2:
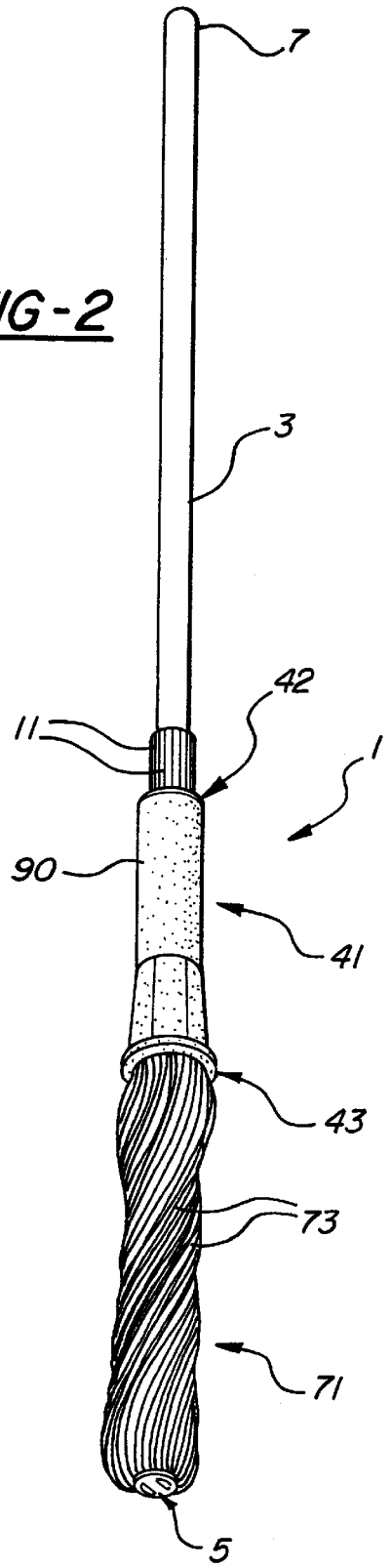
FIG. 2 is an elevational view of the improved self-wringing ratchet mop of the present invention showing the mop swab in a partially wound condition.
Figure 3:
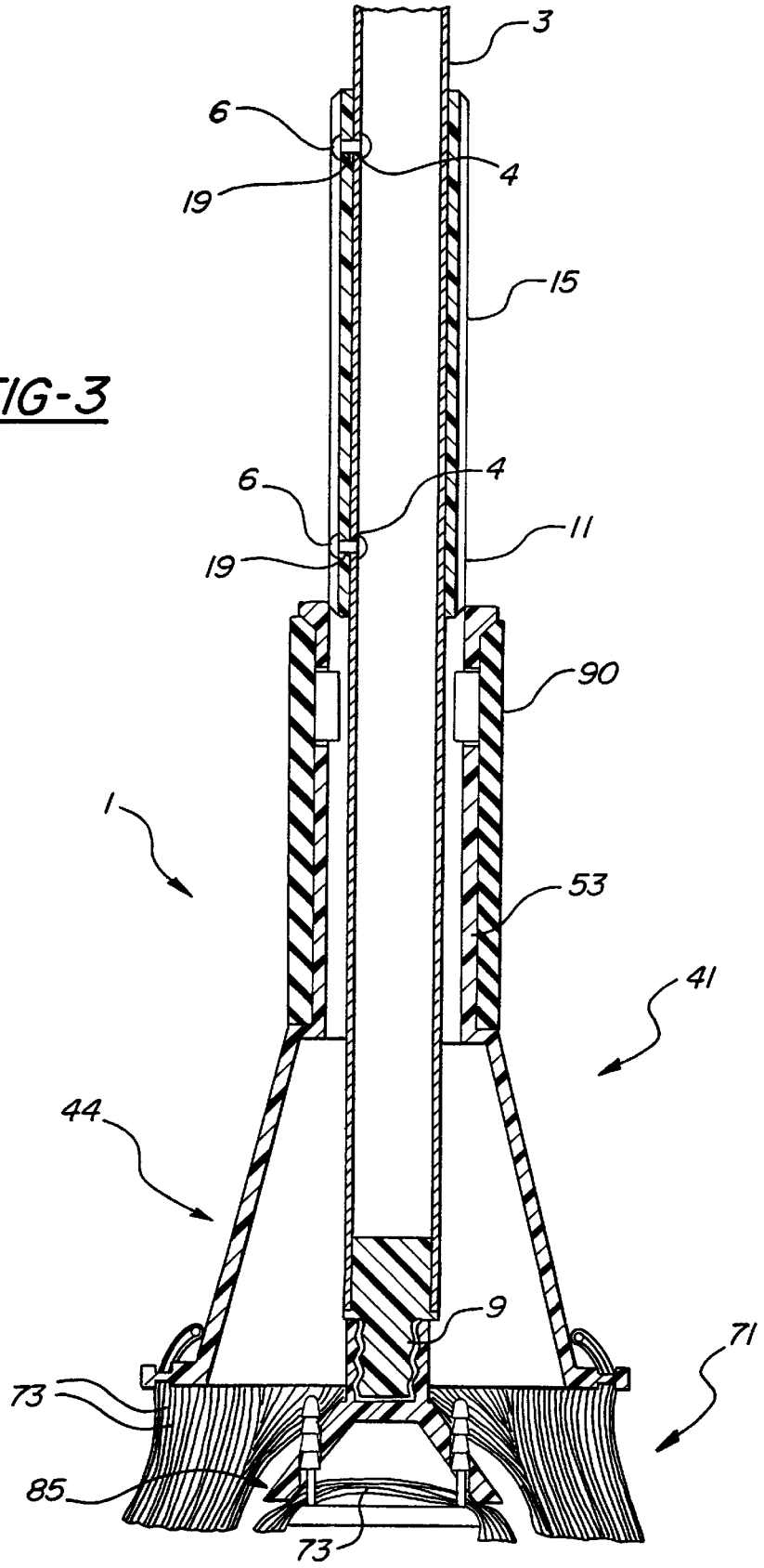
FIG. 3 is a cross-section of the improved self-wringing ratchet mop of the present invention.

Referring now to FIGS. 1–3, the self-wringing ratchet mop 1 of the present invention generally comprises an elongate handle 3 with upper 7 and lower 5 ends, the handle having at least one and preferably a plurality of longitudinal channels 11 provided along a discrete length thereof; a tubular grip sleeve 41 rotatably and slidingly disposed coaxially on handle 3, the grip sleeve having upper 42 and a lower 43 ends; and a mop swab 71 comprising a plurality of strands 73 the opposite ends of which are attached to lower end 43 of sleeve 41 and lower end 5 of handle 3. Strands 73 are preferably made of a suitably absorbent material such as cotton, yarn, chamois, sponge or the like. Attachment of strands 73 to handle 3 is preferably as shown and described in the co-pending patent application, Ser. No. 08/551,151, now U.S. Pat. No. 5,875,509, of one of the inventors of the present invention.

Generally, strands 73 are fixed to an internally threaded member 85 (FIG. 3) which is, in turn, engageable with an externally threaded member 9 provided at lower end 5 of handle 3 to permit attachment of mop swab 71 to handle 3. Of course, it will be appreciated that the attachment of mop swab 71 to handle 3 is not critical to the mop of this invention, and may accordingly be accomplished in any manner known to those of skill in the art.

Still referring to FIG. 3, handle 3 may be either solid or hollow (as shown), and may further be manufactured out of any desired material, including plastic, carbon fiber, wood, metal or the like. To the extent that attachment of mop swab 71 to handle 3 is desired to be accomplished as described herein, external threads 9 may be formed as an integral part of the lower end 5 of the handle 3 or made as a separate component and attached thereto using any means known in the art such as a press fit, adhesive, rivets, stakes, and the like.

Figure 7:
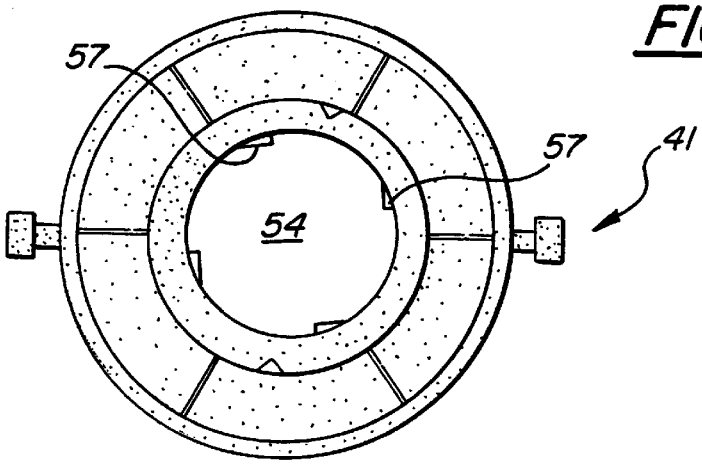
FIG. 7 is a top view of the grip sleeve of the present invention.
Figure 8:
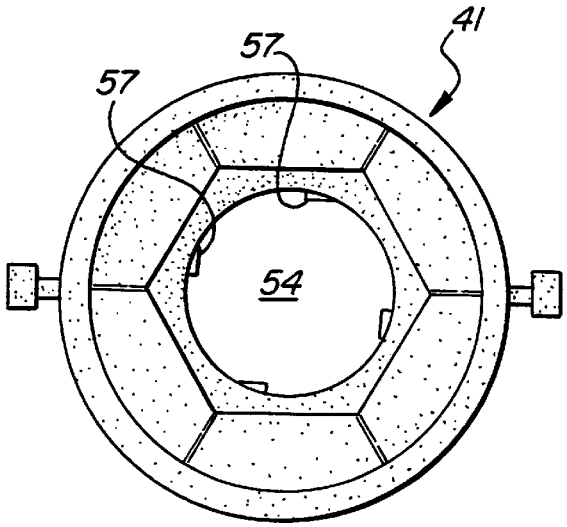
FIG. 8 is a bottom view of the grip sleeve of the present invention.

Referring now to FIGS. 4 and 7–8, tubular grip sleeve 41 generally comprises a grip section 53 and a generally frusto-conically shaped section 44. The construction of section 44 of sleeve 41 is not critical to this invention, and may take any desired shape. An internal passageway 54 extends longitudinally between openings provided at upper and lower ends 42 and 43, handle 3 being slidingly receivable therethrough. As shown, sleeve 41 is of one-piece construction, being preferably injection molded out of a suitable durable polymer such as polyethylene, although the use of other known processes and materials is contemplated. A foam sleeve 90 (FIGS. 1, 2, and 6) extends over grip sleeve 53 to provide for user comfort and an improved grip.

The tubular grip sleeve 41 preferably includes indicia 45 (FIG. 4) thereon instructing the user as to which direction the sleeve must be rotated to wring the mop. Other indicia may also be provided, such as to indicate that grip sleeve 41 must be slid upwardly along the handle to employ the ratchet mechanism hereinafter described. Indicia 45 and any other indicia may take any form, including symbols, words, or the like.

Referring particularly to FIGS. 4–6, at least one pawl 57 is provided on grip sleeve 41 along grip section 53. Pawl 57 is formed integral with grip sleeve 41. In the preferred embodiment, four such pawls are provided equidistant about the circumference of grip sleeve 41, as illustrated in FIG. 6, though one skilled in the art will appreciate that the invention will function suitably well with more or fewer pawls. Each pawl includes an inclined pawl surface 61(FIG. 6) and is cantilevered to flex about a line connecting pivot points 33 (FIG. 5). Flexing of each pawl is effected by providing a longitudinal cut-out section 63 along the edge of a pawl and two circumferential cut-out channels 65 along the top and bottom of pawl 57 leading back to each pivot point 33, thereby defining a living hinge. The length of channels 65 is dependent on the strength and thickness of the material, the tolerances of the channels and pawl, and the forces desired to rotate sleeve 41 about handle 3. It will be appreciated that the material from which grip sleeve 41 is fabricated, as well as the length of channels 65, permit each pawl to be repeatably flexed away from its biased position without deforming the pawl 57.

Figure 9:
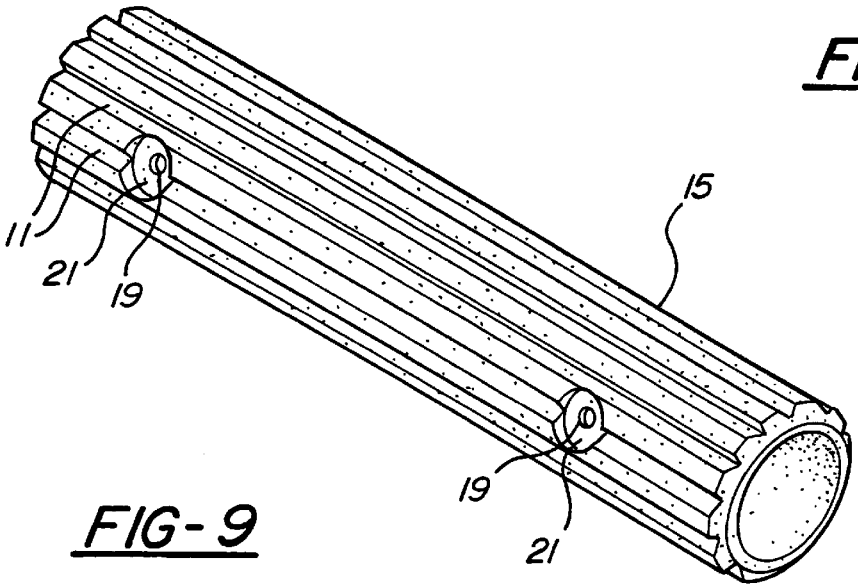
FIG. 9 is a perspective view of the ratchet sleeve of the present invention.

Referring now to FIGS. 3 and 9, longitudinal channels 11 are preferably provided on the exterior surface of a separate ratchet sleeve 15. Ratchet sleeve 15 is preferably molded out of a polymer such as polyethylene, though ratchet sleeve 15 may be manufactured out of other known materials and using known processes. Ratchet sleeve 15 preferably includes a longitudinal passageway defining a diameter slightly larger than the outer diameter of handle 3, so as to permit the handle to be received therethrough. Attachment holes 19 provided on ratchet sleeve 15 correspond with attachment holes 4 provided on handle 3, (FIG. 3) permitting ratchet sleeve 15 to be fastened to handle 3 using fastening means 6 such as rivets or threaded fasteners. Counter bore 21 is provided in the ratchet sleeve 15 to prevent the head of fastening means 6 from interfering with the sliding and rotating operation of grip sleeve 41. A skilled artisan could of course attach ratchet sleeve 15 to handle 3 using numerous other methods such as adhesive, studs, etc. without deviating from the spirit of the present invention. Those of skill in the art will also appreciate that one or more longitudinal channels 11 may also be formed integral with handle 3.

Referring to FIGS. 7–8, bottom and top views of grip sleeve 41 are illustrated. As shown, the inside diameter of passageway 54 of grip section 53 is slightly larger than the outside diameter of ratchet sleeve 15, pawls 57 protruding into the passageway to engage the longitudinal channels of the ratchet sleeve 15 when the grip sleeve 41 is moved thereover (FIG. 6).

In operation, when grip sleeve 41 is slid over ratchet sleeve 15, each of pawls 57 slide into engagement with one of the longitudinal channels 11, such that an inclined channel surface 12 contacts inclined pawl surface 61 and perpendicular channel surface 13 contacts perpendicular pawl surface 59 (FIG. 6). Since perpendicular channel surface 13 and perpendicular pawl surface 59 are in flush contact, it will be appreciated that sleeve 41 cannot easily be rotated in a first, clockwise direction. However, the natural bias of pawl 57 can be overcome with an appropriate amount of force, thereby permitting rotation of grip sleeve 41 in a second, counter-clockwise direction. Thus, pawls 57 are not easily deformed or broken even under circumstances where grip sleeve 41 is rotated in the wrong direction. Of course, those of skill in the art will understand that inclined surfaces 12 and the perpendicular surfaces 59 may be reversed, thereby allowing rotation of grip sleeve 41 in the clockwise direction and preventing rotation in the counter-clockwise direction.

To wring the mop of the present invention, grip sleeve 41 is rotated counter-clockwise relative to handle 3. Inclined pawl surface 61 of each pawl 57 engages and slides over successive inclined channel surfaces 12, forcing pawl 57 to flex on its living hinge radially away from handle 3, and allowing grip sleeve 41 to rotate about handle 3 in one direction. When inclined pawl surface 61 of each pawl 57 passes over the edge of an inclined channel surface 12, the pawl 57 returns to its biased position with perpendicular surfaces 59 and 13 in flush contact with each other to prevent counter-rotation of grip sleeve 41. If grip sleeve 41 is released or slips from the hand of a user, the engagement between perpendicular surfaces 59 and 13 will prevent mop swab 71 from unwinding under pressure from the tensioned swab. Grip sleeve 41 may then be re-gripped and rotated, twisting and wringing mop swab 71 until it is dry.

To return mop swab 71 to its initial, unwound condition (FIG. 1), grip sleeve 41 is slid downward along handle 3 until pawls 57 are disengaged from the channels 11 of ratchet sleeve 15. Once disengaged, it will be appreciated that grip sleeve 41 may be freely rotated in the direction necessary to unwind mop sleeve 71, since there is nothing to prevent rotation of grip sleeve 41 in any direction about handle 3.

Of course, the foregoing is merely illustrative of one embodiment of the present invention. Many additions and modifications, apparent to those of ordinary skill in the art are possible without departing from the spirit and broader aspects of this invention as defined in the appended claims.

The invention in which an exclusive property or privilege is claimed is defined as follows:

1. A self-wringing ratchet mop, comprising:

an elongate handle having at least one channel extending along a discrete length thereof;

a tubular member slidingly and rotatably disposed on said handle, said tubular member including at least one pawl engageable with said at least one channel so as to resist rotation of said tubular member in a first direction about said handle, and said tubular member including a wall cut to define a living hinge upon which said at least one pawl is radially moveable out of engagement with said at least one channel so as to permit rotation of said tubular member in a second direction about said handle;

a mop swab connected to said handle and said tubular member; and wherein further said tubular member is freely rotatable in both said first and second directions about said mop handle when said at least one pawl is positioned along any length of said handle other than said discrete length.

2. The self-wringing ratchet mop of claim 1, wherein said handle includes a plurality of longitudinal channels.

3. The self-wringing ratchet mop of claim 2, wherein said tubular member includes a plurality of pawls.

4. The self-wringing ratchet mop of claim 1, wherein said tubular member defines a passageway therethrough, and said handle further comprises a sleeve member disposed thereon and dimensioned to be receivable within said passageway of said tubular member, said sleeve having an exterior surface upon which is provided said at least one channel.

5. The self-wringing ratchet mop of claim 4, wherein said exterior surface includes a plurality of longitudinal channels thereon.

6. The self-wringing ratchet mop of claim 5, wherein said tubular member includes a plurality of pawls.

7. In a self-wringing ratchet mop of the type having an elongate handle, a tubular member slidingly and rotatably disposed on said handle, and a mop swab connected to said handle and said tubular member, the improvement comprising:

at least one longitudinal channel provided along a discrete length of said handle;

said tubular member being monolithic and having a wall including at least one pawl formed therein, said at least one pawl biased toward engagement with said at least one channel such that, when said at least one pawl is positioned over said discrete length of said handle, said at least one pawl is engageable with said at least one channel to resist rotation of said tubular member in a first direction about said handle;

wherein said pawl includes a living hinge about which said at least one pawl is flexibly radially moveable out of engagement with said at least one channel to permit rotation of said tubular member in a second direction about said handle; and wherein, when said at least one pawl is positioned along a length of said mop handle other than said discrete length, said tubular member is freely rotatable in both said first and second directions about said mop handle.

8. The improved self-wringing ratchet mop of claim 7, wherein said wall of said tubular member is cut to define said living hinge.

9. The improved self-wringing ratchet mop of claim 8, wherein said tubular member defines a passageway therethrough, and said handle further comprises a sleeve member disposed thereon and dimensioned to be receivable within said passageway of said tubular member, said sleeve having an exterior surface upon which is provided said at least one longitudinal channel.

10. The improved self-wringing ratchet mop of claim 9, wherein said exterior surface of said sleeve includes a plurality of longitudinal channels.

11. The improved self-wringing ratchet mop of claim 10, wherein said tubular member includes a plurality of pawls.

12. A self-wringing ratchet mop, comprising:

an elongate handle including at least one channel provided along a length thereof;

a tubular member slidably and rotatably disposed on said handle, said tubular member having a wall defining at least one pawl engageable with said at least one channel; and a mop swab connected to said handle and said tubular member.

13. The self-wringing ratchet mop of claim 12, wherein said at least one channel is oriented parallel to the longitudinal axis of said mop handle.

14. The self-wringing ratchet mop of claim 13, wherein said handle includes a plurality of channels.

15. The self-wringing ratchet mop of claim 14, wherein said tubular member includes a plurality of pawls.

16. The self-wringing ratchet mop of claim 12, wherein said tubular member defines a passageway therethrough, and said handle further comprises a sleeve member disposed thereon and dimensioned to be receivable within said passageway of said tubular member, said sleeve having an exterior surface upon which is provided said at least one channel.

17. The self-wringing ratchet mop of claim 16, wherein said at least one channel is oriented parallel to the longitudinal axis of said mop handle.

18. The self-wringing ratchet mop of claim 17, wherein said handle includes a plurality of channels.

19. The self-wringing ratchet mop of claim 18, wherein said tubular member includes a plurality of pawls.

* * * * *